US005603487A

United States Patent [19]

Couillard

[11] Patent Number: 5,603,487

[45] Date of Patent: Feb. 18, 1997

[54] LOCK PULLER

[76] Inventor: Jean-Guy Couillard, 871 Des Peupliers, Amos, Quebec, Canada, J9T 3C1

[21] Appl. No.: 363,932

[22] Filed: Dec. 27, 1994

[51] Int. Cl.[6] ..... B66F 15/00

[52] U.S. Cl. ..... 254/27; 29/239; 29/267

[58] Field of Search ..... 254/18, 25–27, 254/131, 129, 130, 133; 29/267, 239

[56] References Cited

U.S. PATENT DOCUMENTS 1,220,034 3/1917 Waska .
2,776,108 1/1957 Sherman ..... 254/27
3,367,631 2/1968 Hedemark ..... 254/27
3,619,887 11/1971 McLaughlin .
4,982,493 1/1991 Wendt .

*Primary Examiner*—Robert C. Watson
*Attorney, Agent, or Firm*—Marvin S. Towsend

[57] ABSTRACT

A tool for pulling open a locked door that is framed by frame members. The tool has fulcrum means adapted to bear against the frame members. The tool also has a lever adapted to cooperate with the fulcrum means while pulling on the door to open it. The lever transmits a pulling force to the door while the fulcrum means transmits a reactive force against the frame members so as to minimize damage to the door.

5 Claims, 2 Drawing Sheets

LOCK PULLER

BACKGROUND OF THE INVENTION

1. Field of the Invention

This invention is directed toward a tool for forcefully opening a locked door.

The invention is also directed toward a method for forcefully opening a locked door.

2. Description of the Prior Art

It often happens that the key for a locked door, such as a door on a safety deposit box, is lost. When this happens, the lock on the door must be removed, or the door must be forced open to open up the box so that the contents can be removed. Forcing the door open is difficult to do without severely damaging the door. Further, when the door is a door on a safety deposit box, it is difficult to force the door open without damaging adjacent boxes.

SUMMARY OF THE INVENTION

It is the purpose of the present invention to provide a tool that can be used to forcefully open up a locked door, particularly a locked door on a safety deposit box, with minimum damage to the door and without damaging adjacent boxes.

In accordance with the present invention there is provided a tool with fulcrum means that can be braced against the frame that surrounds the locked door to be opened. A lever is used with the fulcrum means to provide a pulling force on the door. The reaction force from the lever is transmitted by the fulcrum means to the surrounding frame rather than to the door or to adjacent boxes and thus damage to the door and to adjacent boxes is eliminated or at least minimized. The tool preferably is designed to be adjustable so that the tool can be used to open doors of different size. The tool can also be constructed to provide different leverage forces.

The lever of the tool has a short arm with means at its end for use in pulling on a locked door to open it. The lever also has a longer arm for applying leverage to the shorter arm to pull on the locked door with sufficient force to normally force it open. The lever has means rotatably cooperating with the fulcrum means while pulling on the door.

The fulcrum means preferably has a pair of spaced apart plates that can bear, via their edges, against the frame of the box. A fulcrum pin is mounted between the plates. The lever cooperates with the pin between the plates so as to apply equal reaction forces against the frame.

The invention is particularly directed toward a tool for use in forcefully opening a locked door framed by frame members having fulcrum means adapted to bear against the frame members. A lever is provided having a base with means thereon for rotatably cooperating with the fulcrum means. The lever has a short arm and a long arm extending from the base. The short arm has means at its free end for use in connecting it to the door while the lever cooperates with the fulcrum means so as to be able to apply a pulling force on the locked door to pull it open from the frame when a turning force is applied on the free end of the long arm to try to rotate it about the fulcrum means. The turning force applies a reactive pushing force through the fulcrum means against the frame.

BRIEF DESCRIPTION OF THE DRAWINGS

The invention will now be described in detail having reference to the accompanying drawings in which.

DESCRIPTION OF THE PREFERRED EMBODIMENTS

Figure 1:
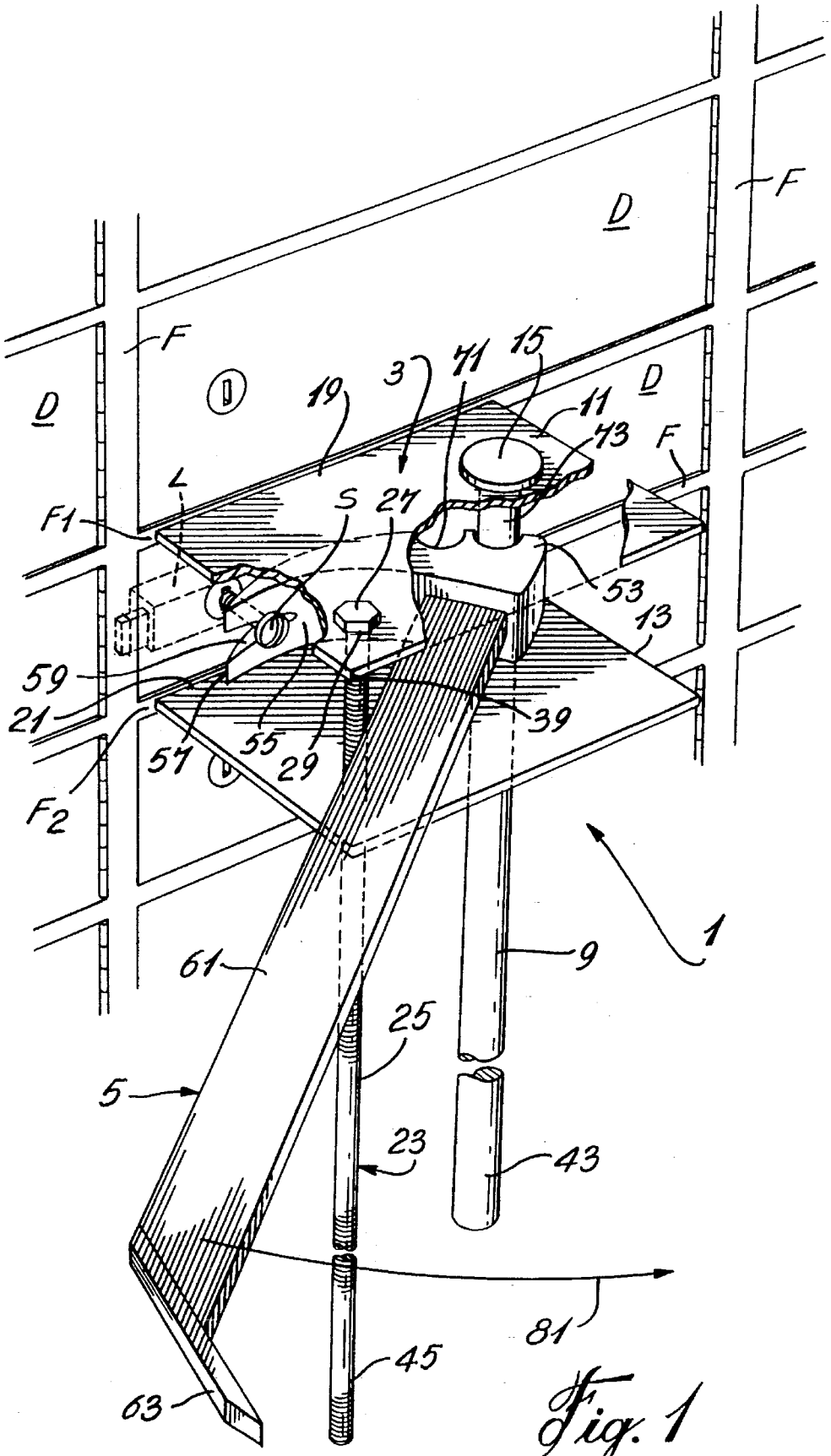
FIG. 1 is a perspective view, in partial section, of the tool in use.

The tool 1 of the present invention has a fulcrum means 3 and a lever 5. The fulcrum means 3 comprises support means and a fulcrum pin 9 carried by the support means. The support means preferably comprises a pair of spaced-apart, parallel plates 11, 13. The plates 11, 13 are preferably rectangular. The fulcrum pin 9 has an enlarged head 15 and loosely extends through holes 17 in both plates 11, 13 with the head 15 resting on the top plate 11. Two long sides 19, 21 of the plates 11, 13 form support edges as will be described.

The plates 11, 13 can be adjusted as to how far apart they are. To this end, adjustment means 23 are provided to allow adjustment between the plates. The adjustment means 23 comprise a threaded rod 25 having a nut 27. The rod 25 extends loosely through holes 29 in both plates 11, 13 with the head 27 resting on the top plate 11. A pair of nuts 31, 33 are threaded onto the rod 25 on either side of the bottom plate 13. The nuts 31, 33 can be adjusted along the rod 25 to adjust the distance of the bottom plate 13 from the top plate 11. The fulcrum pin 9 is generally located toward one corner 37 of the plates 11, 13 while the rod 25 is generally located toward the diagonally opposite corner 39 of the plates. Both the pin 9 and rod 25 are preferably made quite long to extend well past the bottom plate 13. The extending portions 43, 45 of the pin 9 and rod 25 can be grasped as a handle to position the tool.

The lever 5 has a base 53 with a short arm 55 extending therefrom. The short arm 55 is preferably curved and tapers toward its free end 57. A narrow V-shaped slot 59 extends inwardly from the free end 57 of the short arm 55 toward the base portion 53. The lever 5 also has a long arm 61 extending from the base portion 53 generally at a right angle to the short arm 55. A pry bar 63 can be attached to the free end of the long arm 61. The pry bar 63 extends at an angle to the long arm 61 and projects slightly past it. Cooperating notches 71, 73 are provided on the base 53 of the lever 5 for use in having the lever cooperate with the fulcrum pin 9.

Figure 3:
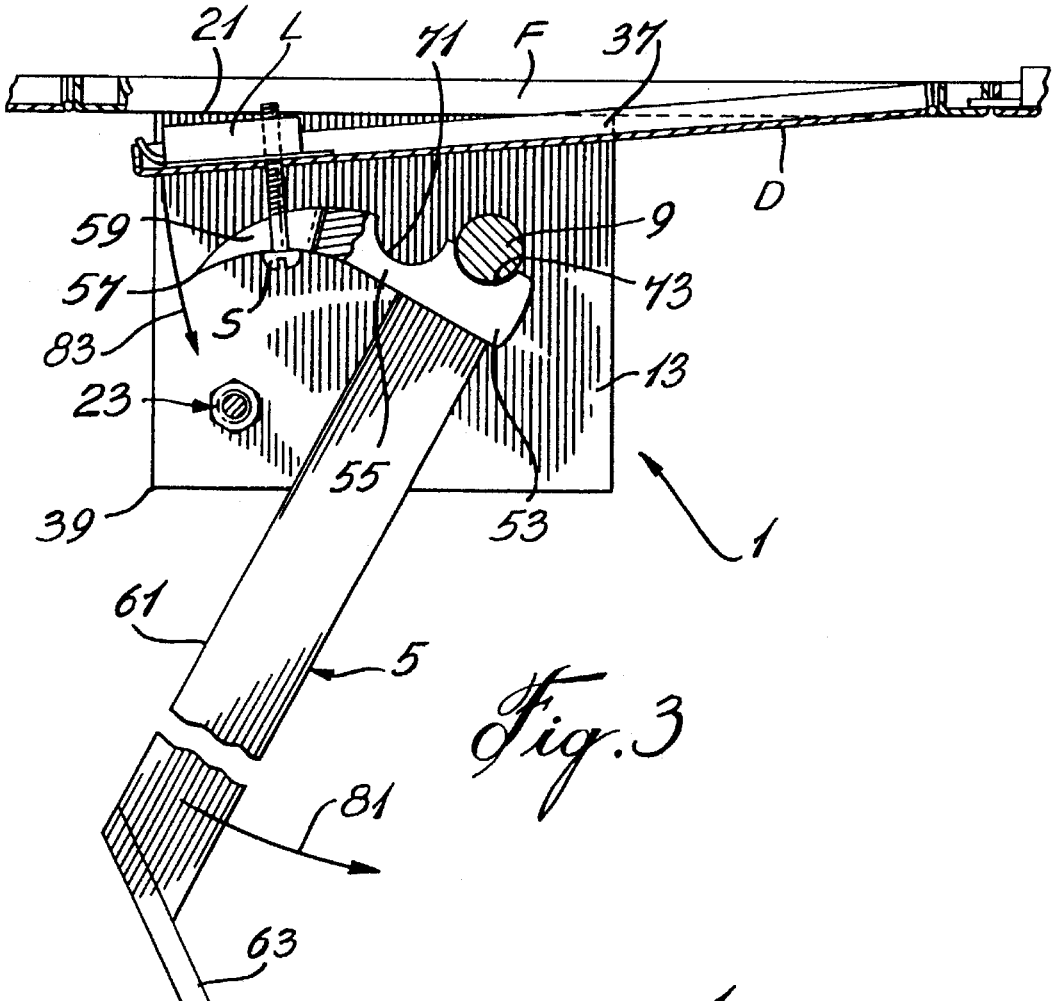
FIG. 3 is a cross-section view of the tool taken along line 3—3 in FIG. 2.
Figure 2:
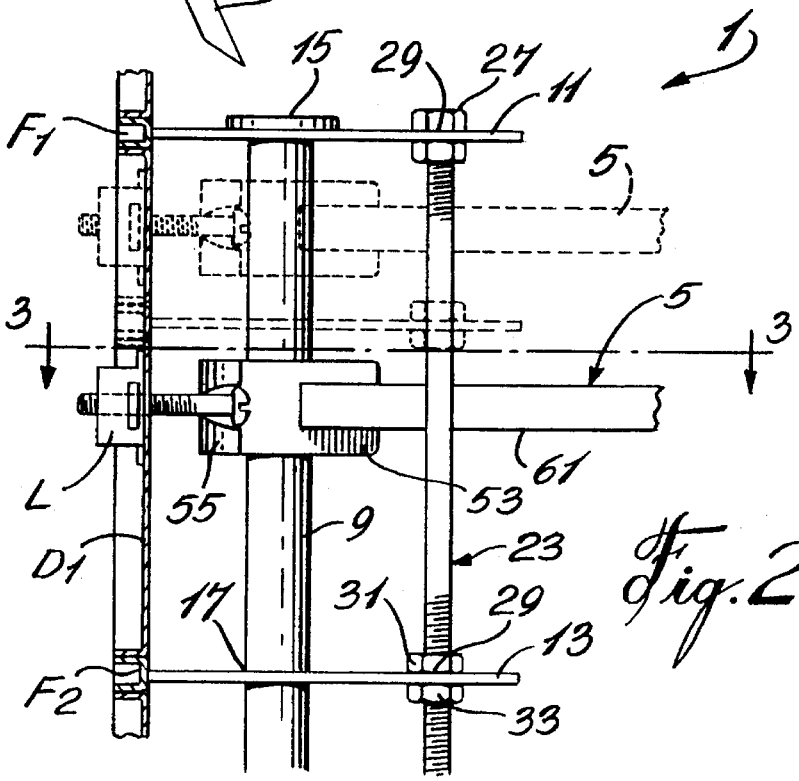
FIG. 2 is an end elevation of the tool.

The tool 1 is used to pry open a locked door. The tool is particularly adapted to pry open a small locked door in an array of boxes such as an array of safety deposit boxes. As shown in FIG. 1 each door D in such an array is framed by frame members F. In using the tool 1, a screw S is threaded into the lock L of the door D1 to be forced open. The fulcrum means 3 of the tool is then adjusted to have the plates 11, 13 spaced apart a distance equal to the distance between the upper and lower frame members F1 and F2 framing the door D1. The plates 11, 13 are adjusted by moving the nuts 31, 33 on the adjustment 25 to allow the bottom plate 13 to move relative to the top plate 11. Once the plates 11, 13 have been spaced apart the correct distance, the fulcrum means 3 is placed over the door D1, using the handle formed by the extending portions 43, 45 of the pin and rod, with the long sides 19, 21 of the plates bearing against the upper and lower frames F1, F2 adjacent the door D1. The lever 5 is now positioned on the fulcrum means 3 with either notch 71, 73, depending on the leverage required, pushed against the fulcrum pin 9 and with the slot 59 on the short arm 55 receiving the screw S. A turning force is now applied on the free end of the long arm 61 of the lever 5 as shown by the arrow 81, moving the lever about the pin 9 and pulling on the head of the screw S to pull the door D1 away from the frames F1, F2 while bending the locking latch L on the door. The force on the door is shown by the arrow 83 in FIG. 3. A reactive force is applied to the frames F1, F2 by the plates 11, 13.

If the door D1 can be only partly pulled open the pry bar 63 on the long arm 61 of the lever 5 could be used to try to fully open the door.

While the preferred tool has the plates 11, 13 adjustable to fit different door sizes, the plates could be fixed a set distance apart if the tool is to be used with a specific size of door. In this case the fulcrum pin 9 could be fixed to the plates and be without it's extension 43. The adjustment means 23 would be eliminated.

I claim:

1. A tool for use in forcefully opening a locked door framed by framing members, comprising: fulcrum means having means adapted to bear against the framing members; a lever having a base and cooperating means thereon for rotatably cooperating with the fulcrum means; the lever having a shoret arm and a long arm extending from the base; the short arm having means at its free end for used in connectin it to the door while the cooperating means cooperates with the fulcrum means so as to be able to apply a pulling force on the locked door to pull it open from the frame when when a turning force is applied on the free end of the long arm to try to turn it about the fulcrum means, the turning force applying a reactive force through the cooperating means and the fulcrum means against the frame, wherein the fulcrum means comprises a pair of parallel, space-apart plate members having edges adapted between the plate members for receiving the cooperating means on the lever, further including adjustment means for adjusting the distance between the plate members.

2. A tool as claimed in claim 1 wherein the adjustment means comprises a threaded adjustment rod extending through the plates parallel to the fulcrum pin, and nuts threaded on the rod on either side of one of the plates, the fulcrum pin also extending through the plates.

3. A tool for use in forcefully opening a locked door framed by framing members, comprising: fulcrum means having means adapted to bear against the framing members; a lever having a base and cooperating means thereon for rotatably cooperating with the fulcrum means; the lever having a shoret arm and a long arm extending from the base; the short arm having means at its free end for used in connectin it to the door while the cooperating means cooperates with the fulcrum means so as to be able to apply a pulling force on the locked door to pull it open from the frame when when a turning force is applied on the free end of the long arm to try to turn it about the fulcrum means, the turning force applying a reactive force through the cooperating means and the fulcrum means against the frame, wherein the fulcrum means comprises a pair of parallel, space-apart plate members having edges adapted to abut against the framing members, and a fulcrum pin extending between the plate members for receiving the cooperating means on the lever, wherein the cooperating means comprises at least one part-circular cutout in the base of the lever for receiving the fulcrum pin.

4. A tool as claimed in claim 3 wherein the cooperating means includes a second part-circular cutout adjacent the first cutout, the fulcrum pin mounted in either cutout depending on the leverage required.

5. A tool as claimed in claim 2 wherein both the fulcrum pin and the adjustment rod extend well past the plates to provide a handle portion that can be gripped to position the tool.

* * * * *